US011933306B2

(12) United States Patent
Hirami et al.

(10) Patent No.: US 11,933,306 B2
(45) Date of Patent: Mar. 19, 2024

(54) SCROLL COMPRESSOR AND REFRIGERATION CYCLE APPARATUS

(71) Applicant: Mitsubishi Electric Corporation, Tokyo (JP)

(72) Inventors: Tetsuro Hirami, Tokyo (JP); Tomokazu Matsui, Tokyo (JP); Yuji Takamura, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 150 days.

(21) Appl. No.: 17/602,816

(22) PCT Filed: Jun. 28, 2019

(86) PCT No.: PCT/JP2019/025910
§ 371 (c)(1),
(2) Date: Oct. 11, 2021

(87) PCT Pub. No.: WO2020/261558
PCT Pub. Date: Dec. 30, 2020

(65) Prior Publication Data
US 2022/0154719 A1 May 19, 2022

(51) Int. Cl.

| | |
|---|---|
| ***F03C 2/00*** | (2006.01) |
| ***F03C 4/00*** | (2006.01) |
| ***F04C 2/00*** | (2006.01) |
| ***F04C 18/00*** | (2006.01) |
| ***F04C 18/02*** | (2006.01) |
| ***F04C 18/10*** | (2006.01) |

(Continued)

(52) U.S. Cl.
CPC ..... *F04C 29/025* (2013.01); *F04C 18/0207* (2013.01); *F04C 18/10* (2013.01);
(Continued)

(58) Field of Classification Search
CPC ..... F04C 18/0207; F04C 18/0215; F04C 18/0253; F04C 18/082; F04C 18/10;
(Continued)

(56) References Cited

U.S. PATENT DOCUMENTS

2004/0156734 A1 8/2004 Furusho et al.
2018/0372103 A1* 12/2018 Choi ..... F04C 29/023
2019/0309750 A1* 10/2019 Nakai ..... F04C 29/0007

FOREIGN PATENT DOCUMENTS

JP 61192881 A * 8/1986 ..... F04C 18/0215
JP 2000329082 A * 11/2000 ..... F04C 18/0215
(Continued)

OTHER PUBLICATIONS

JP-2000329082A—Hagita N—Scroll Compressor and Refrigerating Plant—Nov. 28, 2000—the machine English Translation. (Year: 2000).*
KR1020110131751A—Park et al.—Scroll compressor—Dec. 7, 2011—the machine English Translation. (Year: 2011).*
JP61-192881A—Kitayama—Scroll Type Compressor—Aug. 27, 1986—the English Machine Translation. (Year: 1986).*
(Continued)

*Primary Examiner* — Theresa Trieu
(74) *Attorney, Agent, or Firm* — POSZ LAW GROUP, PLC

(57) ABSTRACT

A scroll compressor includes an orbiting bedplate which has an oil passage through which oil flows outward in a radial direction of the orbiting bedplate, a lap-side oil supply hole that causes the oil passage to communicate with a lap-formation surface of the orbiting lap, and a thrust-surface-side oil supply hole that causes the oil passage to communicate with a thrust surface of the orbiting bedplate that is opposite to the lap-formation surface of the orbiting bedplate. An opening and closing mechanism provided in the oil passage closes the thrust-surface-side oil supply hole when
(Continued)

the pressure of oil that is drawn from an oil sump by an oil pump and supplied into the oil passage is low, and opens the thrust-surface-side oil supply hole when the pressure of the oil is high.

14 Claims, 6 Drawing Sheets

(51) Int. Cl.
*F04C 29/02* (2006.01)
*F04C 23/00* (2006.01)

(52) U.S. Cl.
CPC ..... *F04C 29/028* (2013.01); *F04C 23/008* (2013.01); *F04C 2210/206* (2013.01); *F04C 2240/60* (2013.01)

(58) Field of Classification Search
CPC .. F04C 23/008; F04C 29/0007; F04C 29/023; F04C 29/025; F04C 29/028; F04C 2210/206; F04C 2240/60; F25B 1/04
See application file for complete search history.

(56) References Cited

FOREIGN PATENT DOCUMENTS

| | | | | | |
|---|---|---|---|---|---|
| JP | 2003-254263 | A | | 9/2003 | |
| JP | 2010-285930 | A | | 12/2010 | |
| JP | 6425744 | B | | 11/2018 | |
| KR | 1020110131751 | A | * | 12/2011 | ..... F04C 18/0215 |

OTHER PUBLICATIONS

International Search Report of the International Searching Authority dated Sep. 10, 2019 for the corresponding International application No. PCT/JP2019/025910 (and English translation).

Office Action dated May 10, 2022 issued in corresponding JP Patent Application No. 2021-527295 (and English translation).

* cited by examiner

SCROLL COMPRESSOR AND REFRIGERATION CYCLE APPARATUS

CROSS REFERENCE TO RELATED APPLICATION

This application is a U.S. national stage application of International Application No. PCT/JP2019/025910 filed on Jun. 28, 2019, the contents of which are incorporated herein by reference.

TECHNICAL FIELD

The present disclosure relates to a scroll compressor that is widely used for compression of refrigerant in, for example, an air-conditioning apparatus, and a refrigeration cycle apparatus.

BACKGROUND

A scroll compressor incorporated in, for example, an air-conditioning apparatus, a refrigeration apparatus, or a water heating apparatus, includes a compression mechanism that compresses refrigerant in compression chambers defined by a fixed scroll and an orbiting scroll combined together and a rotating shaft that drives the compression mechanism. The fixed scroll and the orbiting scroll each include a bedplate and laps formed on the bedplate. The laps are combined to define the compression chambers. As the orbiting scroll orbits, the compression chambers move while decreasing in volume, thus achieving suction and compression of refrigerant in the compression chambers.

This type of scroll compressor includes a positive-displacement oil pump that is provided at a lower end of the rotating shaft to lubricate the compression mechanism with oil. The oil pump draws oil collected in an oil sump at the bottom of a container, and supplies the oil to the compression mechanism through an oil supply passage provided in the rotating shaft. The bedplate of the orbiting scroll has a lap-formation surface on which the laps are formed. A surface of the bedplate that is located on the opposite side of the lap-formation surface is a thrust surface to support a thrust load. The orbiting scroll slides over the thrust surface while orbiting. Thus, in order to prevent, for example, occurrence of seizure at the thrust surface, it is also necessary to supply oil to the thrust surface.

In view of the above, in an existing compressor, an orbiting scroll includes an orbiting bedplate having an oil passage through which oil from an oil pump flows. In this compressor, the oil in the oil passage is supplied to both a lap-formation surface of the orbiting bedplate and a thrust surface thereof that is opposite to the lap-formation surface (refer to Patent Literature 1, for example). In Patent Literature 1, the orbiting bedplate further has a lap-side oil supply hole that extends from the oil passage to the lap-formation surface of the orbiting bedplate and a thrust-surface-side oil supply hole that extends from the oil passage to the thrust surface, thus enabling oil to be supplied to both the laps and the thrust surface.

PATENT LITERATURE

Patent Literature 1: Japanese Patent No. 6425744

In the compressor disclosed in Patent Literature 1, oil is supplied by a positive-displacement oil pump. The amount of oil that is supplied depends on the rotation speed of a rotating shaft. In a high-speed operation in which the rotating shaft rotates at a high speed, the oil may be excessively supplied from an oil sump to a compression mechanism. Because of such excessive supply of the oil, the amount of outgoing oil, which is oil discharged from the compressor together with the refrigerant compressed in the compression mechanism, increases. Consequently, the amount of oil in the compressor decreases, thus lowering the reliability. Furthermore, in a low-speed operation in which the rotating shaft rotates at a low speed, the amount of oil drawn by the oil pump decreases, thus also decreasing the amount of oil that is supplied to the compression chambers.

In the compressor disclosed in Patent Literature 1, since the oil passage in the orbiting bedplate communicates with both the lap-side oil supply hole and the thrust-surface-side oil supply hole at all times, the amount of oil that is supplied to the compression chambers is very small in the low-speed operation. Consequently, sealing of the space between the compression chambers defined by the laps combined together is poor, and a refrigerant leaks may occur a larger number of times, thus lowering the performance of the compressor. In order to improve the performance in the low-speed operation, the flow area of the lap-side oil supply hole may be increased. However, in the case where the flow area of the lap-side oil supply hole is increased, in the high-speed operation, oil is excessively supplied to the compression chambers, as a result of which the amount of outgoing oil may greatly increase.

SUMMARY

The present disclosure is applied in view of the above circumferences, and relates to a scroll compressor that is improved in both the performance in a low-speed operation and the reliability of sliding parts in a high-speed operation, and also to a refrigeration cycle apparatus.

A scroll compressor according to an embodiment of the present disclosure includes: a container including an oil sump configured to collect oil; a compression mechanism housed in the container, and configured to compress refrigerant that flows into the container; a rotating shaft configured to drive the compression mechanism, and having an oil supply passage; and an oil pump configured to be driven by rotation of the rotating shaft to supply the oil collected in the oil sump to the oil supply passage in the rotating shaft. The compression mechanism includes an orbiting scroll including an orbiting bedplate and an orbiting lap formed at the orbiting bedplate. In the orbiting bedplate, an oil passage, a lap-side oil supply hole, and a thrust-surface-side oil supply hole are formed. The oil passage is configured as a passage through which the oil supplied from the oil supply passage flows from inner part of the oil passage in a radial direction of the orbiting bedplate toward outer part of the oil passage in the radial direction. The lap-side oil supply hole causes the oil passage to communicate with a lap-formation surface of the orbiting bedplate at which the orbiting lap is formed. The thrust-surface-side oil supply hole causes the oil passage to communicate with a thrust surface of the orbiting bedplate that is opposite to the lap-formation surface of the orbiting bedplate. In the oil passage, an opening and closing mechanism is provided. The opening and closing mechanism closes the thrust-surface-side oil supply hole when the pressure of the oil in the oil passage is low, and opens the thrust-surface-side oil supply hole when the pressure of the oil in the oil passage is high.

According to the embodiment of the present disclosure, it is possible to achieve oil supply to the lap and oil supply to the thrust surface that are appropriate for the rotation speed of the rotating shaft. Specifically, when the pressure of the oil in the oil passage in the low-speed operation is low, the thrust-surface-side oil supply hole is closed, thereby causing oil to be supplied only to the lap side through the lap-side oil supply hole. As a result, sealing in the compression mechanism in the low-speed operation is improved, and the performance is also improved. Additionally, in the high-speed operation, the thrust-surface-side oil supply hole is opened, thereby causing oil to be supplied to the thrust surface. It is therefore possible to ensure reliability of sliding parts in the high-speed operation.

DETAILED DESCRIPTION

Compressors according to embodiments of the present disclosure will be described with reference to the drawings. It should be noted that in each of the figures including FIG. 1, components that are the same as those in a previous figure or figures are denoted by the same reference signs, and the same is true of the entire text of the following descriptions concerning the embodiments. Furthermore, in the entire text of the specification, the configurations of components are described by way of example, that is, the configurations of the components are not limited to those described in the entire text. High and low pressures and compression ratios are not determined in relation to absolute values, but are relatively determined based on, for example, a status or an operation of, for example, a system or an apparatus. The same is true of high and low rotation speeds of a rotating shaft. Additionally, it should be noted that the relationship between the sizes of components in the figures that will be referred to below may differ from that between the actual sizes of the components.

Embodiment 1

Figure 1:
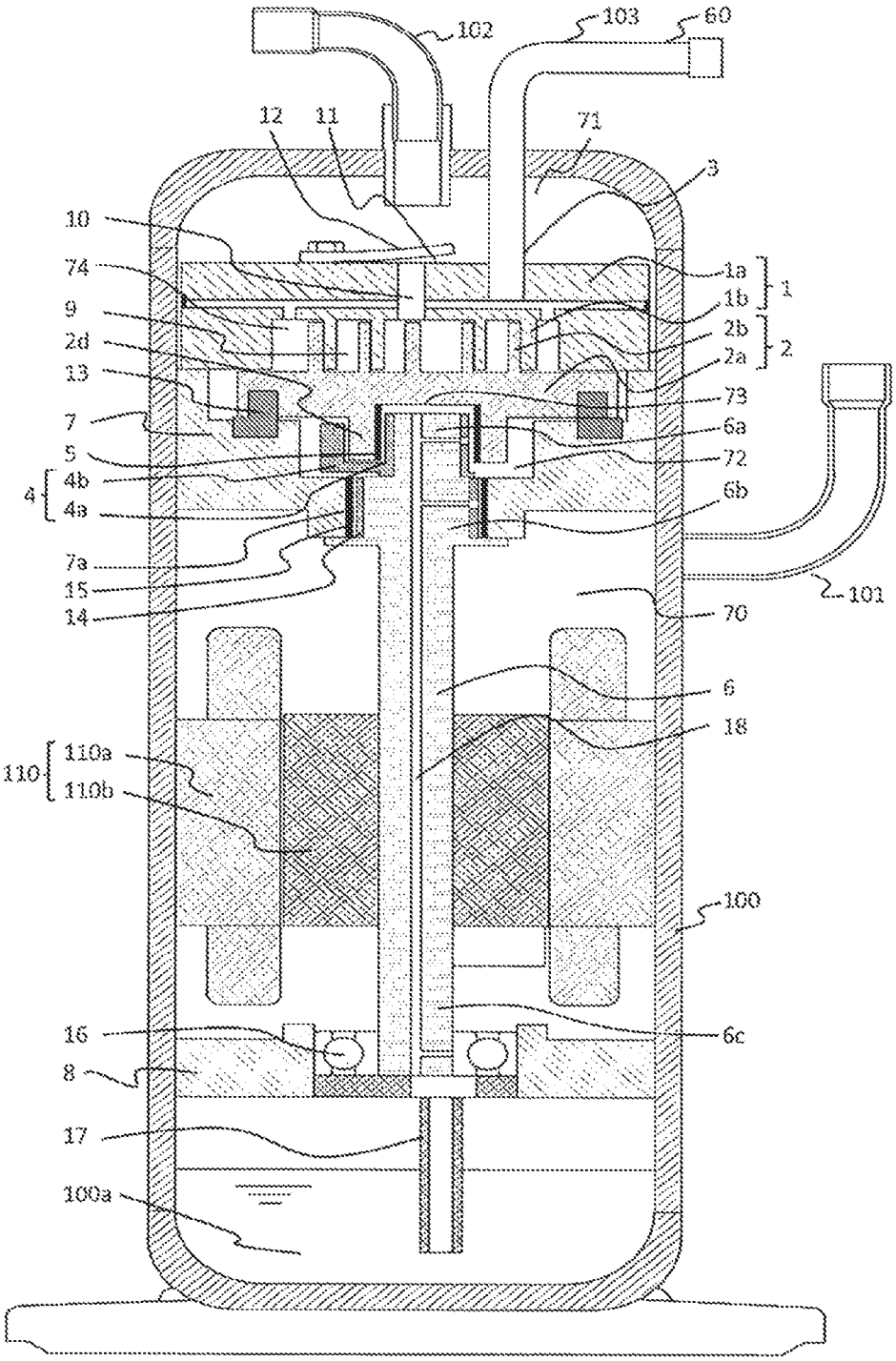
FIG. 1 is a schematic vertical sectional view of an overall configuration of a scroll compressor according to Embodiment 1.

FIG. 1 is a schematic vertical sectional view of an overall configuration of a scroll compressor according to Embodiment 1. The compressor includes a compression mechanism 3, a rotating shaft 6, a motor mechanism 110, and other components. The compressor includes a container 100 that forms an outer shell of the compressor and houses the above components. The compression mechanism 3 is provided in upper part of the container 100, and the motor mechanism 110 is provided in lower part thereof. The compression mechanism 3 and the motor mechanism 110 are coupled by the rotating shaft 6, and a rotational force generated by the motor mechanism 110 is transmitted to the compression mechanism 3 through the rotating shaft 6. The rotational force causes the compression mechanism 3 to compress refrigerant. The compressor according to Embodiment 1 is a low-pressure shell compressor in which the container 100 is filled with refrigerant to be compressed by the compression mechanism 3. As the refrigerant to be compressed by the compressor, for example, carbon dioxide is used. It should be noted that the refrigerant is not limited to carbon dioxide, and any other refrigerant may be used.

The compression mechanism 3 is supported by a frame 7. The frame 7 is fixed to an inner circumferential surface of the container 100 by, for example, shrink fitting or welding. The frame 7 is provided between the compression mechanism 3 and the motor mechanism 110 in the container 100. The frame 7 has a shaft hole 7*a* at central part of the frame 7. The rotating shaft 6 extends through the shaft hole 7*a*.

A sub-frame 8 is provided below the motor mechanism 110 in the container 100. The sub-frame 8 is fixed to the inner circumferential surface of the container 100 by, for example, shrink fitting or welding. The container 100 has an oil sump 100*a* at bottom part of the container 100. In the oil sump 100*a*, refrigerating machine oil that lubricates the compression mechanism 3 and sliding part including bearings is collected. An oil pump 17 is fixed to a lower end of the rotating shaft 6. The oil pump 17 is, for example, a positive-displacement pump, such as a trochoid pump. As the rotating shaft 6 rotates, the oil pump 17 draws the oil collected in the oil sump 100*a* through an oil supply passage 18 provided in the rotating shaft 6. The drawn oil is supplied to the bearings and compression chambers 9 to lubricate the bearings and seal a gap between the compression chambers 9.

The container 100 includes a suction pipe 101 to suck the refrigerant and a discharge pipe 102 to discharge the refrigerant. The container 100 has a low-pressure suction space 70 that is located below the frame 7 and is filled with the refrigerant sucked through the suction pipe 101. The container 100 further has a high-pressure discharge space 71 that is located closer to the discharge pipe 102 than a fixed bedplate 1*a* (which will be described later) of the compression mechanism 3 and is filled with the refrigerant discharged from the compression mechanism 3. In addition, the upper part of the container 100 is connected to an injection pipe 103 of an injection mechanism 60 that injects the refrigerant introduced from the outside into a lap-side suction space 74 located around a lap, which will be described later, or the compression chambers 9, which will also be described later.

The compression mechanism 3 includes a fixed scroll 1 and an orbiting scroll 2 provided under the fixed scroll 1. The fixed scroll 1 is fixed with respect to the frame 7. The orbiting scroll 2 is provided in a space between the fixed scroll 1 and the frame 7. Between the orbiting scroll 2 and the frame 7, an Oldham ring 13 is provided to prevent rotation of the orbiting scroll 2.

The fixed scroll 1 includes the fixed bedplate 1*a* and a fixed lap 1*b* protruding from one surface of the fixed bedplate 1*a*. The orbiting scroll 2 includes an orbiting bedplate 2*a* and an orbiting lap 2*b* that protrudes from one surface of the orbiting bedplate 2*a*. The fixed scroll 1 and the orbiting scroll 2 are arranged in the container 100 such that the fixed lap 1*b* and the orbiting lap 2*b* are combined in antiphase with each other and formed in a symmetric spiral pattern with respect to the center of rotation of the rotating shaft 6. The fixed lap 1*b* and the orbiting lap 2*b* define the compression chambers 9 therebetween. The compression chambers 9 decrease in volume as the compression chambers 9 move from an outer side toward an inner side in the radial direction thereof with rotation of the rotating shaft 6.

The fixed bedplate 1*a* of the fixed scroll 1 has a discharge port 10 that extends through the fixed bedplate 1*a* and communicates with the compression chambers 9. To an outlet of the discharge port 10, a discharge valve 11 and a valve holding-down part 12 are attached. The discharge valve 11 opens or closes the discharge port 10, and the valve holding-down part 12 restricts the range of movement of the discharge valve 11.

The orbiting bedplate 2*a* of the orbiting scroll 2 has a cylindrical boss 2*d* that is located at substantially the center of a surface (hereinafter referred to as a "thrust surface") of the bedplate that is opposite to a surface thereof on which the orbiting lap 2*b* is formed. An orbiting bearing 5 is fixed inward of the boss 2*d*. The orbiting bearing 5 is made of a bearing material that is used for sliding bearings, such as copper-lead alloy. The bearing material is press-fitted in and fixed to the boss 2*d*.

A slider 4 provided with a balancer is rotatably provided inward of the orbiting bearing 5. The slider 4 includes a cylindrical slider portion 4*a* and a balancer portion 4*b* that are joined together by, for example, shrink fitting. The slider portion 4*a* is fitted in an eccentric shaft portion 6*a* (which will be described later) located at an upper end of the rotating shaft 6. The slider portion 4*a* is movable relative to the eccentric shaft portion 6*a* to automatically adjust the radius of orbit of the orbiting scroll 2 in an orbiting motion of the orbiting scroll 2. The slider portion 4*a* is provided such that the fixed lap 1*b* and the orbiting lap 2*b* are necessarily in contact with each other when the orbiting scroll 2 orbits. The balancer portion 4*b* is located beside the slider portion 4*a* and is provided to cancel out a centrifugal force of the orbiting scroll 2 to reduce vibration of compression elements.

As described above, the orbiting scroll 2 is connected to the eccentric shaft portion 6*a* of the rotating shaft 6 by the slider 4 provided with the balancer. The orbiting scroll 2 orbits with rotation of the rotating shaft 6 while the radius of the orbiting motion is being automatically adjusted by the slider 4. A thrust surface 2*ab* of the orbiting bedplate 2*a* of the orbiting scroll 2 and the frame 7 define therebetween a cylindrical bearing operating space 72. While the orbiting scroll 2 is orbiting, the orbiting bearing 5 rotates together with the slider 4 in the bearing operating space 72.

The rotating shaft 6 has a main shaft portion 6*b* located below the eccentric shaft portion 6*a*. The main shaft portion 6*b* is fitted in a main bearing 15, with a sleeve 14 interposed between the main shaft portion 6*b* and the main bearing 15, and slides relative to the main bearing 15, with a layer of oil interposed between the main shaft portion 6*b* and the main bearing 15. The main bearing 15 is fixed to the frame 7 by, for example, press-fitting a bearing material that is used for sliding bearings, such as copper-lead alloy, into the frame 7. The eccentric shaft portion 6*a*, which is eccentric to the main shaft portion 6*b*, is provided at the upper end of the rotating shaft 6. An upper end face of the eccentric shaft portion 6*a* and the orbiting bedplate 2*a* define therebetween an internal space 73 into which the refrigerating machine oil flowing out from an upper opening of the oil supply passage 18 in the rotating shaft 6 flows.

The sub-frame 8 includes a sub-bearing 16, which is a ball bearing, at central part of the sub-frame 8. The sub-bearing 16 is located below the motor mechanism 110, and supports the rotating shaft 6 in the radial direction. The sub-bearing 16 may be another type of bearing, that is, a given bearing other than the ball bearing. The rotating shaft 6 has a sub-shaft portion 6*c* that is located below the motor mechanism 110. The sub-shaft portion 6*c* is fitted in the sub-bearing 16, and slides relative to the sub-bearing 16, with a layer of oil interposed between the sub-shaft portion 6*c* and the sub-bearing 16. The centers of the main shaft portion 6*b* and the sub-shaft portion 6*c* coincide with the center of the rotating shaft 6.

The motor mechanism 110 includes a motor stator 110*a* and a motor rotor 110*b*. To receive power from the outside, the motor stator 110*a* is connected to a glass terminal (not illustrated) located between the frame 7 and the motor stator 110*a* by a lead (not illustrated). The motor rotor 110*b* is fixed to the rotating shaft 6 by shrink fitting, for example.

Next, an operation of the scroll compressor according to Embodiment 1 will be described.

When power is supplied to the motor stator 110*a* of the motor mechanism, the motor rotor 110*b* is given a rotational force and thus rotates. The rotating shaft 6 fixed to the motor rotor 110*b* is thus driven and rotated with rotation of the motor rotor 110*b*. As the rotating shaft 6 is rotated, the orbiting scroll 2 fitted to the eccentric shaft portion 6*a* of the rotating shaft 6 orbits while rotation of the orbiting scroll 2 on the axis thereof is being prevented by the Oldham ring 13. The refrigerant sucked into the container 100 through the suction pipe 101 is sucked into the compression chambers 9 via the lap-side suction space 74 located around the lap. As the orbiting scroll 2 orbits, the compression chambers 9 move toward the center of the compression mechanism 3 while decreasing in volume. Thus, the refrigerant in the compression chambers 9 is compressed. The compressed refrigerant is discharged to the discharge space 71 through the discharge port 10 and is then discharged from the container 100 through the discharge pipe 102.

The flow of oil will be described.

As the rotating shaft 6 is rotated with the rotation of the motor rotor 110*b*, oil in the oil sump 100*a* is drawn by the oil pump 17. The oil drawn by the oil pump 17 flows upward through the oil supply passage 18 in the rotating shaft 6. The oil flows in the radial direction on the way and is supplied to the bearings. After lubricating the bearings, the oil is returned to the oil sump 100*a*.

After flowing out from the upper opening of the oil supply passage 18 in the rotating shaft 6, the oil flows through the internal space 73, lubricates the orbiting bearing 5, and is then returned to the oil sump 100*a*. Part of the oil that has lubricated the orbiting bearing 5 is supplied to the thrust surface 2*ab* and lubricates the thrust surface 2*ab* and the Oldham ring 13. After that, the oil is sucked together with low-pressure gas refrigerant into the compression chambers 9 of the compression mechanism 3. In the compression chambers 9, the sucked oil seals a gap between the fixed lap 1*b* and the orbiting lap 2*b* and lubricates the laps.

As described above, in the case where the oil pump 17 is a positive-displacement oil pump, the amount of oil that is supplied to the compression chambers 9 and the sliding parts increases in a high-speed operation in which the rotation speed is high, whereas the amount of oil that is supplied to the compression chambers 9 and the sliding parts decreases in a low-speed operation. When the amount of oil that is supplied to the compression chambers 9 decreases, a refrigerant leak, which will be described later, occurs, thereby deteriorating the performance of the compressor.

A refrigerant leak that occurs in the case where the amount of oil that is supplied to the compression chambers 9 is not sufficient in the low-speed operation will be described.

Figure 2:
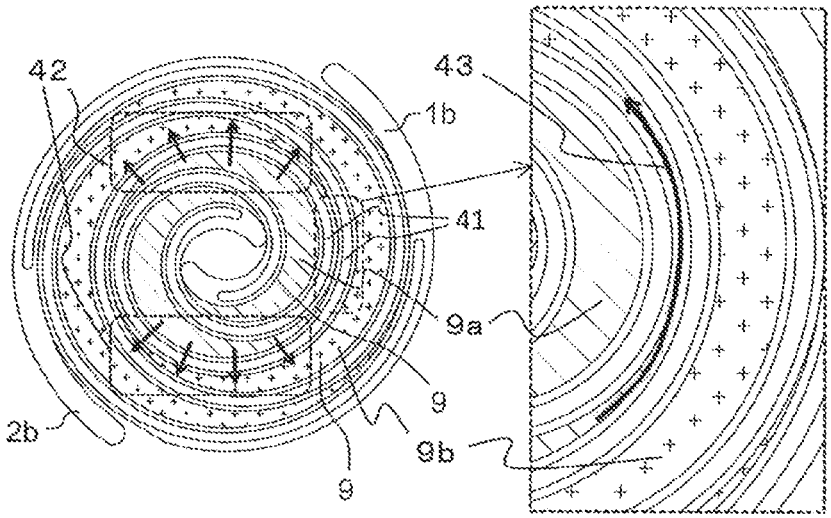
FIG. 2 is a cross-sectional view illustrating compression chambers defined by an orbiting lap of an orbing scroll and a fixed lap of a fixed scroll in the scroll compressor according to Embodiment 1.

FIG. 2 is a cross-sectional view illustrating the compression chambers defined by the orbiting lap of the orbiting scroll and the fixed lap of the fixed scroll in the scroll compressor according to Embodiment 1.

The pressure in each of the compression chambers 9 increases as the compression chamber 9 moves toward the center of the lap, thereby causing a pressure difference between the compression chambers 9, which are adjacent to each other. Because of the pressure difference, the compressed refrigerant leaks from a radially inner compression chamber 9 to a radially outer compression chamber 9, for example, from an innermost chamber 9*a* to an intermediate chamber 9*b*. This leak deteriorates the performance of the compressor.

In a distal end of each of the fixed lap 1*b* and the orbiting lap 2*b*, a sealing material 41 is embedded to prevent occurrence of a refrigerant leak. To be more specific, the sealing material 41 prevents a refrigerant leak from a gap between the distal end of each of the laps and the bedplate that faces the distal end. However, a leak passage is present at not only the distal ends of the laps but also the sides of the laps. Specifically, the fixed lap 1*b* and the orbiting lap 2*b* operate in contact with each other. A leak preventing component is not provided between the sides of the fixed lap 1*b* and the orbiting lap 2*b*. The oil sucked together with the refrigerant into the compression chambers 9 plays a large role as a sealing material. As indicated by arrows in FIG. 2, as passages of refrigerant leaks, the following leaks are present: a radial leak 42 that occurs from a high-pressure side to a low-pressure side of the laps; and a circumferential leak 43 that occurs from a gap between the sides of the laps.

The oil adheres to the distal ends of the laps and the sides of the laps, and can thus seal the gaps between the compression chambers 9 even when the laps are located in any phase. If a refrigerant leak occurs, the lower the rotation speed of the compressor, the larger the effect of the refrigerant leak on the performance of the compressor. Therefore, in order to improve the performance of the compressor in the case where the rotation speed thereof is in a low speed range, it is necessary to increase the amount of oil that is sucked into the compression chambers 9 in the low-speed operation of the compressor.

In the related art, an orbiting bedplate of an orbiting scroll is made to have an oil passage through which oil drawn by an oil pump flows, and further have a lap-side oil supply hole and a thrust-surface-side oil supply hole, which communicate with the oil passage, whereby the oil is supplied to both a thrust surface and laps. In a low-speed operation, the oil is supplied from the lap-side oil supply hole to the compression chambers to seal a gap between the laps, thereby reducing occurrence of a refrigerant leak from the gap. However, in this structure, since the oil passage communicates with both the thrust surface and the laps at all times, in the low-speed operation, the amount of oil supplied from the lap-side oil supply hole to the compression chambers is not sufficient.

In view of the above, in Embodiment 1, the orbiting bedplate 2*a* of the orbiting scroll 2 is configured as described below to increase the amount of oil that is sucked into the compression chambers 9 in the low-speed operation.

Figure 3:
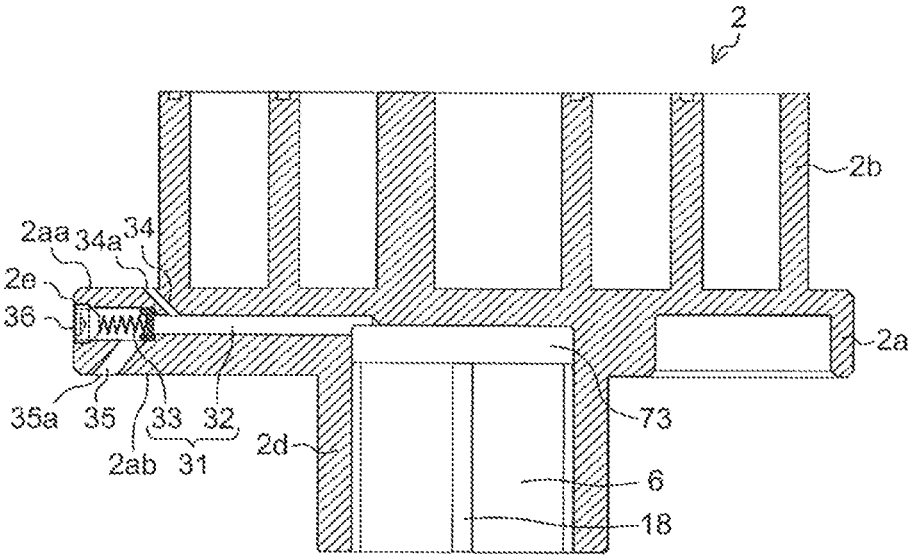
FIG. 3 is a schematic sectional view of the orbiting scroll of the scroll compressor according to Embodiment 1.
Figure 4:
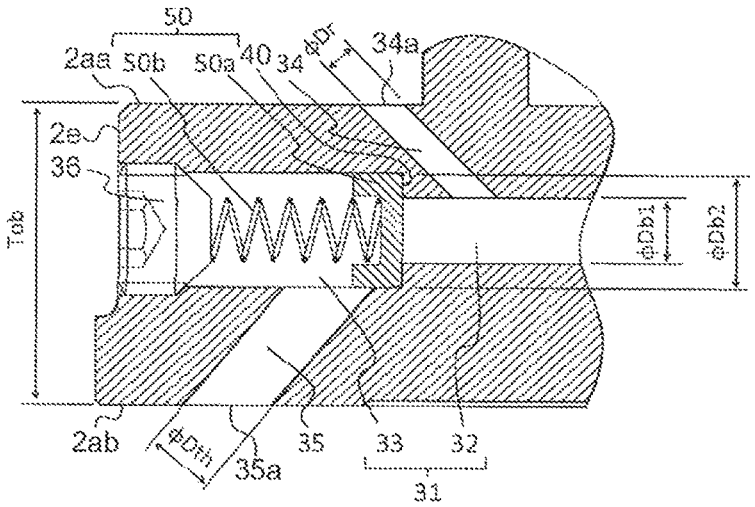
FIG. 4 is a detail view illustrating an opening and closing mechanism of the scroll compressor according to Embodiment 1.

FIG. 3 is a schematic sectional view of the orbiting scroll of the scroll compressor according to Embodiment 1. FIG. 4 is a detail view illustrating an opening and closing mechanism of the scroll compressor according to Embodiment 1.

The orbiting bedplate 2*a* of the orbiting scroll 2 includes an oil passage 31, a lap-side oil supply hole 34, a thrust-surface-side oil supply hole 35, and an opening and closing mechanism 50. The oil passage 31 is a hole that extends in the orbiting bedplate 2*a* in a radial direction thereof. The oil passage 31 extends from the internal space 73 to a side 2*e* of the orbiting bedplate 2*a*. The oil passage 31 has an outer end in the radial direction that is closed by a bolt 36 or a sealing material.

The oil passage 31 is a passage through which oil supplied from the oil supply passage 18 flows outward in the radial direction, and includes a first flow passage 32 that is provided in inner part of the orbiting bedplate 2*a* in the radial direction, and a second flow passage 33 that is provided in outer part of the orbiting bedplate 2*a* in the radial direction and has a larger diameter than the diameter of the first flow passage 32.

The lap-side oil supply hole 34 is a hole that causes the oil passage 31 to communicate with a lap-formation surface 2*aa* of the orbiting bedplate 2*a* and extends from the first flow passage 32 to the lap-formation surface 2*aa* of the orbiting bedplate 2*a*. The thrust-surface-side oil supply hole 35 is a hole that causes the oil passage 31 to communicate with the thrust surface 2*ab* of the orbiting bedplate 2*a* and extends from the second flow passage 33 to the thrust surface 2*ab*. The lap-side oil supply hole 34 has an opening 34*a* provided in the lap-formation surface 2*aa*. The thrust-surface-side oil supply hole 35 has an opening 35*a* provided in the thrust surface. The opening 34*a* is located inward of the opening 35*a* in the radial direction.

The dimensions of the oil passage 31, the lap-side oil supply hole 34, and the thrust-surface-side oil supply hole 35 will be described. The orbiting bedplate 2*a* of the orbiting scroll 2 has a thickness Tob, the first flow passage 32 has a diameter $\phi Db1$, and the second flow passage 33 has a diameter $\phi Db2$. These dimensions have, for example, the following relationship: $(1.8\times\phi Db1)<(1.5\times\phi Db2)<Tob$.

Furthermore, the lap-side oil supply hole 34 has a diameter $\phi Dr$, and the thrust-surface-side oil supply hole 35 has a diameter $\phi Dth$. These dimensions have, for example, the following relationship: $\phi Dr\times1.5\leq\phi Dth$.

The opening and closing mechanism 50 opens or closes the thrust-surface-side oil supply hole 35, depending on the pressure of the oil that is drawn by the oil pump 17 and supplied to the first flow passage 32 of the oil passage 31. The opening and closing mechanism 50 is provided in the second flow passage 33 of the oil passage 31. The opening and closing mechanism 50 includes a valve body 50*a* that slides in the second flow passage 33 to open or close the thrust-surface-side oil supply hole 35 and an urging part 50*b* that urges the valve body 50*a* in a direction in which the thrust-surface-side oil supply hole 35 is closed. The valve body 50*a* is urged inward in the radial direction by an urging force of the urging part 50*b* and is pressed against a step 40 formed by the first flow passage 32 and the second flow passage 33, thus closing the thrust-surface-side oil supply hole 35 for the first flow passage 32. The urging part 50*b* includes a compression spring that urges the valve body 50*a* inward in the radial direction and is compressed when the valve body 50*a* moves outward in the radial direction.

Next, an operation of the opening and closing mechanism 50 will be described.

Figure 5:
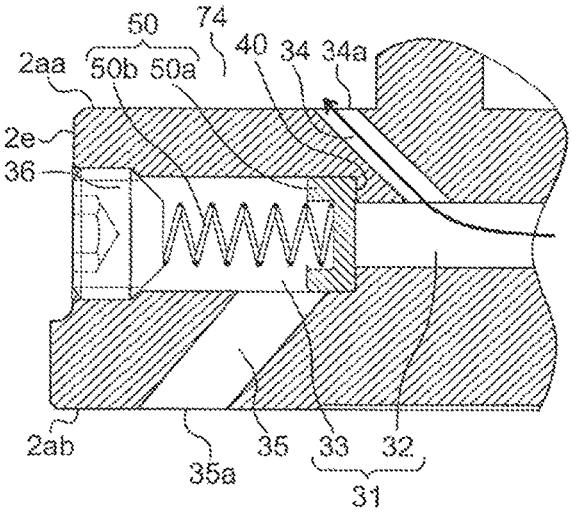
FIG. 5 illustrates a state of the opening and closing mechanism in a low-speed operation of the scroll compressor according to Embodiment 1.

FIG. 5 illustrates a state of the opening and closing mechanism in the low-speed operation of the scroll compressor according to Embodiment 1.

In the low-speed operation in which the rotation speed of the compressor is at or below a predetermined rotation speed, the pressure of the oil drawn by the oil pump 17 and supplied to the first flow passage 32 of the oil passage 31 via the internal space 73 is lower than the value of the urging force of the urging part 50*b*, and the valve body 50*a* is thus unable to move outward in the radial direction, Thus, the valve body 50*a* is in contact with the step 40 to close the thrust-surface-side oil supply hole 35, and the whole oil supplied to the first flow passage 32 is supplied to the lap-side suction space 74 through the lap-side oil supply hole 34 as indicated by an arrow in FIG. 5. The oil supplied to the lap-side suction space 74 is sucked together with the refrigerant into the compression chambers 9, and serves as a sealing member for the space between the compression chambers 9 and the distal ends of the laps.

As described above, the opening and closing mechanism 50 closes the thrust-surface-side oil supply hole 35 in the low-speed operation, thereby causing the whole oil supplied to the first flow passage 32 to be supplied to the compression chambers 9 through the lap-side oil supply hole 34. It is therefore possible to improve sealing of the space between the compression chambers 9 in the low-speed operation and also improve the performance of the compressor, compared with the compressor of the related art in which the oil passage 31 communicates with both the thrust surface and the laps at all times.

Figure 6:
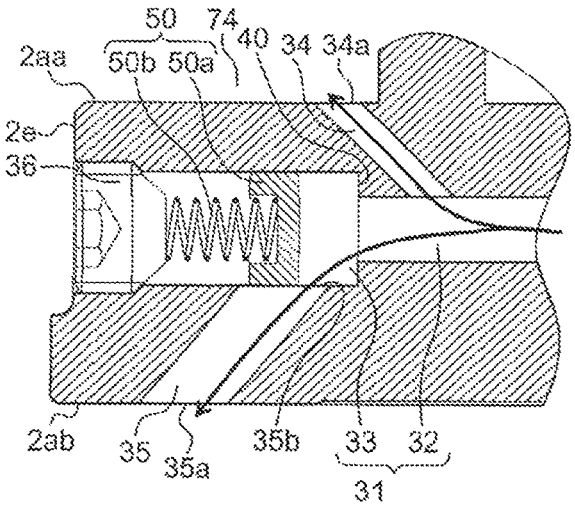
FIG. 6 illustrates a state of the opening and closing mechanism in a medium-speed operation of the scroll compressor according to Embodiment 1.

FIG. 6 illustrates a state of the opening and closing mechanism in a medium-speed operation of the scroll compressor according to Embodiment 1.

In a medium-speed operation in which the rotation speed of the compressor is above the predetermined rotation speed, the amount of oil that is transferred per unit time by the oil pump 17 is larger than that in the low-speed operation, thus increasing the pressure of the oil in the first flow passage 32 of the oil passage 31. The increased pressure of the oil in the oil passage 31 exceeds the value of the urging force of the urging part 50*b*, and as a result the valve body 50*a* slides outward in the radial direction to open the thrust-surface-side oil supply hole 35. Thus, the oil supplied to the first flow passage 32 is supplied to both the lap-side oil supply hole 34 and the thrust-surface-side oil supply hole 35 as indicated by arrows in FIG. 6.

The thrust-surface-side oil supply hole 35 is opened in the medium-speed operation, but is not fully opened. The valve body 50*a* closes part of an opening 35*b* located on the second passage side. A rotation speed of the compressor at which the thrust-surface-side oil supply hole 35 begins to be opened depends on the position of the thrust-surface-side oil supply hole 35 in the radial direction. Therefore, a rotation speed of the compressor at which oil supply to the thrust surface is started can be set based on the position of the thrust-surface-side oil supply hole 35 in the radial direction. For example, in the case where the position of the thrust-surface-side oil supply hole 35 is shifted inward in the radial direction, oil supply to the thrust surface is started when the rotation speed is close to a low speed, and the amount of oil that is supplied to the laps decreases.

In the case where the thrust-surface-side oil supply hole 35 is made to have a larger diameter, with the position of the central axis of the thrust-surface-side oil supply hole 35 in the radial direction kept unchanged, oil supply to the thrust surface is started earlier, and the amount of oil that is supplied to the thrust surface in the case where the rotation speed is high increases.

As described above, the timing at which the oil is supplied to the thrust surface in the medium-speed operation and the amount of oil that is supplied to the thrust surface in the medium-speed operation can be adjusted by changing the position and diameter of the thrust-surface-side oil supply hole 35.

Figure 7:
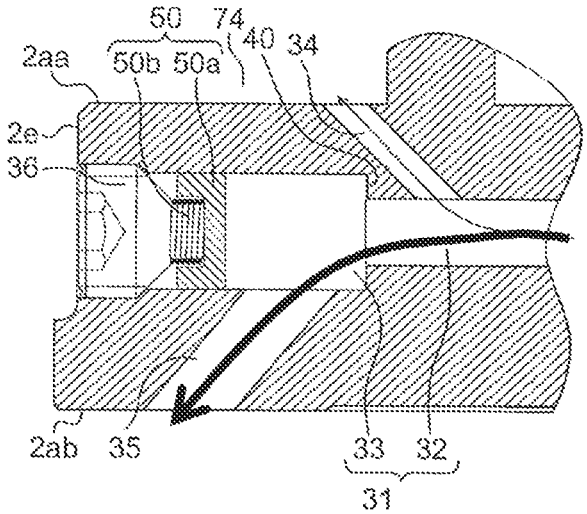
FIG. 7 illustrates a state of the opening and closing mechanism in a high-speed operation of the scroll compressor according to Embodiment 1.

FIG. 7 illustrates a state of the opening and closing mechanism in the high-speed operation of the scroll compressor according to Embodiment 1.

In the high-speed operation in which the rotation speed of the compressor is above the rotation speed of the compressor in the medium-speed operation, the pressure of the oil in the oil passage 31 exceeds the value of the urging force of the urging part 50*b*, and as a result, the valve body 50*a* moves outward in the radial direction to fully open the thrust-surface-side oil supply hole 35. Thus, the amount of oil that is supplied to the thrust surface is dominant over and larger than that to the laps as indicated by arrows in FIG. 7, thus achieving sufficient supply of the oil to the thrust surface. Therefore, the reliability of the sliding parts in the high-speed operation is improved.

Figure 8:
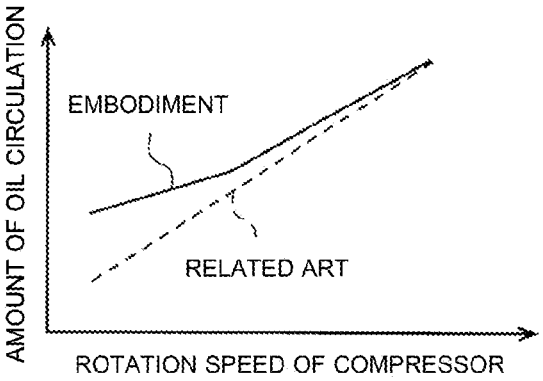
FIG. 8 is a diagram illustrating the amount of oil circulation in the scroll compressor according to Embodiment 1 that varies depending on a rotation speed of the compressor.
Figure 9:
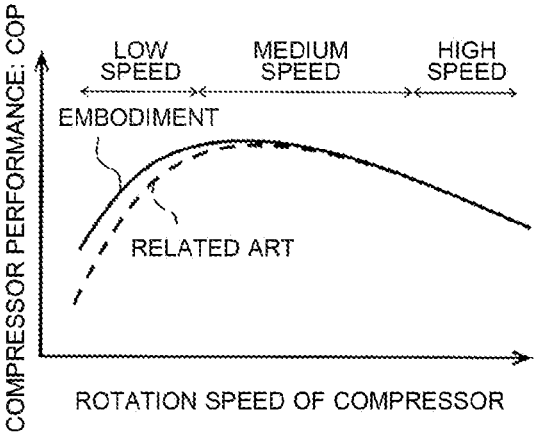
FIG. 9 is a diagram illustrating a COP of the scroll compressor according to Embodiment 1 that depends on the rotation speed of the compressor.

FIG. 8 is a diagram illustrating the amount of oil circulation in the scroll compressor according to Embodiment 1 that varies depending on a rotation speed of the compressor. The amount of oil circulation is the amount of oil contained in the refrigerant discharged from the compressor. FIG. 9 is a diagram illustrating a COP of the scroll compressor according to Embodiment 1 that depends on the rotation speed of the compressor. The COP is the coefficient of performance, and an index indicating the performance of a compressor. For comparison, FIGS. 9 and 10 also indicate the characteristics of the compressor of the related art that has only the thrust-surface-side oil supply hole 35 and has no lap-side oil supply hole.

As indicated in FIG. 8, in Embodiment 1, when the amount of oil that is supplied to the laps in the low-speed operation increases, the amount of oil circulation increases. When the amount of oil circulation increases, the amount of oil that is sucked into the compression chambers 9 increases, thereby improving a sealing characteristic to reduce occurrence of a leak between the compression chambers 9. As a result, as indicated in FIG. 9, the COP in the low-speed operation is improved, as compared with the compressor of the related art.

In operations subsequent to the low-speed operation, the oil circulation amount increases as the rotation speed increases, thus ensuring an oil circulation amount and a COP that are similar to those of the compressor of the related art.

As described above, the scroll compressor according to Embodiment 1 includes: the container 100 including the oil sump 100*a* to collect the oil, the compression mechanism 3 that is housed in the container 100 to compress refrigerant that flows into the container 100; the rotating shaft 6 that drives the compression mechanism 3 and has the oil supply passage 18; and the oil pump 17 that is driven by rotation of the rotating shaft 6 to supply oil collected in the oil sump 100*a* to the oil supply passage 18 in the rotating shaft 6. The compression mechanism 3 includes the orbiting scroll 2 provided with the orbiting bedplate 2*a* and the orbiting lap 2*b* that is formed at the orbiting bedplate 2*a*. The orbiting bedplate 2*a* of the orbiting scroll 2 includes: the oil passage 31 through which oil supplied from the oil supply passage 18 flows outward in the radial direction; the lap-side oil supply hole 34 that causes the oil passage 31 to communicate with the lap-formation surface 2*aa* of the orbiting bedplate 2*a*, at which the orbiting lap 2*b* is formed; and the thrust-surface-side oil supply hole 35 that causes the oil passage 31 to communicate with the thrust surface 2*ab* that is located on the opposite side of the lap-formation surface 2*aa* of the orbiting bedplate 2*a*. The opening and closing mechanism configured to close the thrust-surface-side oil supply hole 35 at a low pressure of the oil in the oil passage 31 and open the thrust-surface-side oil supply hole 35 at a high pressure of the oil in the oil passage 31 is provided in the oil passage 31.

As described above, the opening and closing mechanism 50 is provided in the oil passage 31. The opening and closing mechanism 50 opens or closes the thrust-surface-side oil supply hole 35 in accordance with the pressure of the oil in the oil passage 31 that is based on the rotation speed of the rotating shaft 6. Because of this configuration, it is possible to achieve oil supply to the lap and oil supply to the thrust surface that are appropriate for the rotation speed of the compressor. Since the pressure of the oil in the oil passage 31 is low in the low-speed operation in which the rotation speed of the rotating shaft 6 is low, the thrust-surface-side oil supply hole 35 is closed by the opening and closing mechanism 50, and oil is supplied only to the lap-formation surface through the lap-side oil supply hole 34. As a result, the amount of oil that is sucked into the compression chambers 9 in the low-speed operation increases, thereby improving the sealing characteristic, and thus improving the performance of the compressor. Furthermore, since the pressure of the oil in the oil passage 31 is high in the high-speed operation in which the rotation speed of the rotating shaft 6 is high, the thrust-surface-side oil supply hole 35 is opened, and oil is supplied to the thrust surface 2*ab*, thus ensuring the reliability of the sliding parts in the high-speed operation.

In Embodiment 1, the opening and closing mechanism 50 includes the valve body 50*a* that slides in the oil passage 31 to open or close the thrust-surface-side oil supply hole 35 and the urging part 50*b* that urges the valve body 50*a* in the direction in which the thrust-surface-side oil supply hole 35 is closed. When the pressure of the oil that acts on the valve body 50*a* in the oil passage 31 exceeds the urging force of the urging part 50*b*, the valve body 50*a* moves outward in the radial direction in the oil passage 31 to open the thrust-surface-side oil supply hole 35.

In Embodiment 1, the oil passage 31 includes the first flow passage 32 that is located in inner part of the oil passage 31 in the radial direction, and the second flow passage 33 that is located in outer part of the oil passage 31 in the radial direction and located outward of the first flow passage 32 in the radial direction. Also, the second flow passage 33 has a larger diameter than the diameter of the first flow passage 32. The lap-side oil supply hole 34 extends from the first flow passage 32 to the lap-formation surface 2*aa*. The thrust-surface-side oil supply hole 35 extends from the second flow passage 33 to the thrust surface 2*ab*. The valve body 50*a* is provided in the second flow passage 33, and is pressed by the urging force of the urging part 50*b* against the step 40 formed by the first flow passage 32 and the second flow passage 33 to close the thrust-surface-side oil supply hole 35.

As described above, the opening and closing mechanism 50 includes the valve body 50*a* and the urging part 50*b*. In Embodiment 1, for an oil supply control, it is only required that the valve body 50*a* and the urging part 50*b* are added. Thus, the performance of the compressor and the reliability thereof are improved at a minimum cost.

In Embodiment 1, the urging part 50*b* is a compression spring that is compressed when the valve body 50*a* moves outward in the radial direction.

In such a manner, a compression spring can be used as the urging part 50*b*.

In Embodiment 1, the thrust-surface-side oil supply hole 35 has a larger diameter than the lap-side oil supply hole 34.

Because of the above configuration, in the high-speed operation, when the thrust-surface-side oil supply hole 35 is fully opened, supply of the oil to the thrust surface through the thrust-surface-side oil supply hole 35 is dominant, thus improving the reliability of the sliding parts in the high-speed operation.

In Embodiment 1, a scroll compressor 21 is a low-pressure shell type scroll compressor in which the container 100 is filled with refrigerant that has not yet been compressed by the compression mechanism 3, but may be a high-pressure shell type scroll compressor in which the container 100 is filled with refrigerant that has been compressed by the compression mechanism 3.

In Embodiment 1, as the oil pump 17, a positive displacement pump, such as a trochoid pump, can be used.

Although the scroll compressor according to Embodiment 1 incorporates the injection mechanism 60 to inject the refrigerant into the lap-side suction space 74 located around the orbiting lap 2*b* or the compression chambers 9 of the compression mechanism 3 in which compression is being performed, the scroll compressor may be configured without incorporating the injection mechanism 60.

The scroll compressor according to Embodiment 1 can use carbon dioxide as the refrigerant.

In Embodiment 1, for the oil supply control, it is only required that the valve body and the spring are added. Thus, the performance of the compressor and the reliability thereof can be improved at a minimum cost.

Embodiment 2

In Embodiment 2, a plurality of thrust-surface-side oil supply holes 35 are provided. In this regard, Embodiment 2 is different from Embodiment 1. The following description is made by referring mainly to the differences between Embodiments 1 and 2. Regarding Embodiment 2, components that are the same as those in Embodiment 1 will not be described.

Figure 10:
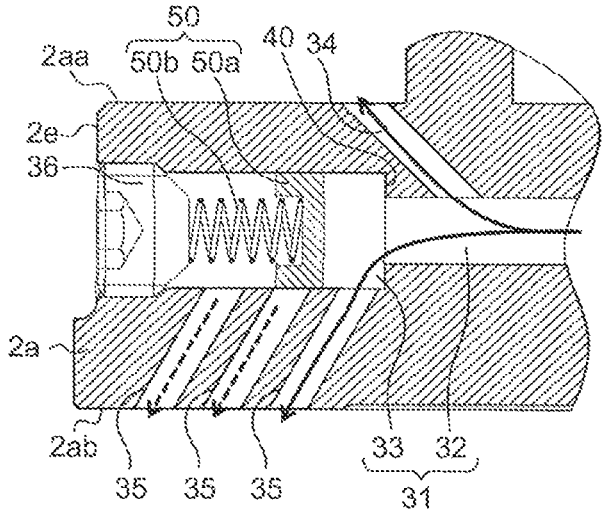
FIG. 10 is a schematic sectional view of related part of a scroll compressor according to Embodiment 2.

FIG. 10 is a schematic sectional view of related part of a scroll compressor according to Embodiment 2.

In Embodiment 1, the single thrust-surface-side oil supply hole 35 is provided in the orbiting bedplate 2*a*. By contrast, in Embodiment 2, a plurality of thrust-surface-side oil supply holes 35 are provided. The thrust-surface-side oil supply holes 35 are formed in the orbiting bedplate 2*a* and spaced from each other in the radial direction.

Since the thrust-surface-side oil supply holes 35 are spaced from each other in the radial direction, the number of thrust-surface-side oil supply holes 35 communicating with the second flow passage 33 varies depending on the oil pressure in the first flow passage 32. That is, the area of an oil passage for oil that is supplied to the thrust surface is adjusted based on the rotation speed of the compressor in a stepwise manner. Therefore, the area of the oil supply passage to the thrust surface can be adjusted based on the rotation speed of the compressor in a stepwise manner in the medium-speed operation in which the rotation speed of the compressor is lower than that in the high-speed operation in which the thrust-surface-side oil supply holes 35 are all opened.

According to Embodiment 2, it is possible to obtain the same advantages in Embodiment 1. Also, in Embodiment 2, since the plurality of thrust-surface-side oil supply holes 35 are provided and spaced from each other in the radial direction, it is possible to adjust in a stepwise manner, the amount of oil that is supplied to the thrust surface in the medium-speed operation.

Since the thrust-surface-side oil supply holes 35 are provided in the thrust surface 2*ab* and spaced from each other in the radial direction, it is possible to widen the range of oil supply in the radial direction in which oil is supplied directly from the thrust-surface-side oil supply holes 35 to the thrust surface 2*ab*, as compared with a configuration in which a single thrust-surface-side oil supply hole 35 is provided. It is therefore possible to improve the reliability of the sliding parts.

The diameters of the thrust-surface-side oil supply holes 35 can each be set at an arbitrary value as long as the diameters are larger than or equal to that of the lap-side oil supply hole 34. Thus, the relationship between the diameters of the thrust-surface-side oil supply holes 35 is arbitrary.

Embodiment 3

Embodiment 3 is different from Embodiment 1 in the configuration of the valve body 50*a*. The following description is made by referring mainly to the differences between Embodiments 1 and 3. Regarding Embodiment 3, configurations that are the same as those in Embodiment 1 will not be described.

Figure 11:
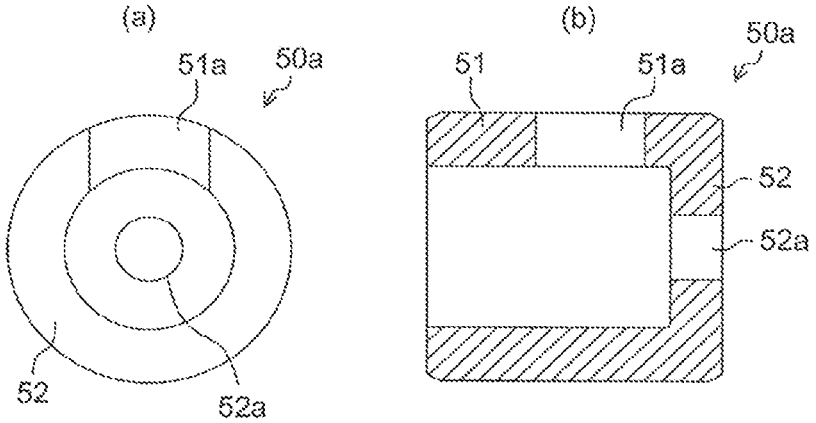
FIG. 11 illustrates a valve body of an opening and closing mechanism of a scroll compressor according to Embodiment 3.

FIG. 11 illustrates a valve body of an opening and closing mechanism of a scroll compressor according to Embodiment 3. To be more specific, FIG. 11(*a*) is a side view of the valve body, and FIG. 11(*b*) is a vertical sectional view of the valve body.

In Embodiment 3, the valve body 50*a* includes the cylindrical portion 51 that slides in the second flow passage 33, and the circular plate portion 52 that closes the opening of the cylindrical portion 51 that is adjacent to the first flow passage 32 and has the through-hole 52*a* at central part of the circular plate portion 52. The cylindrical portion 51 has the communication hole 51*a* that communicates with the lap-side oil supply hole 34 while the valve body 50*a* is being pressed against the step 40.

Figure 12:
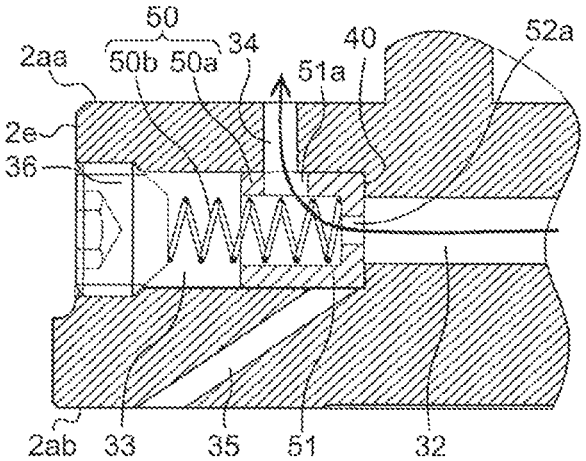
FIG. 12 illustrates a state of the opening and closing mechanism in the low-speed operation of the scroll compressor according to Embodiment 3.
Figure 13:
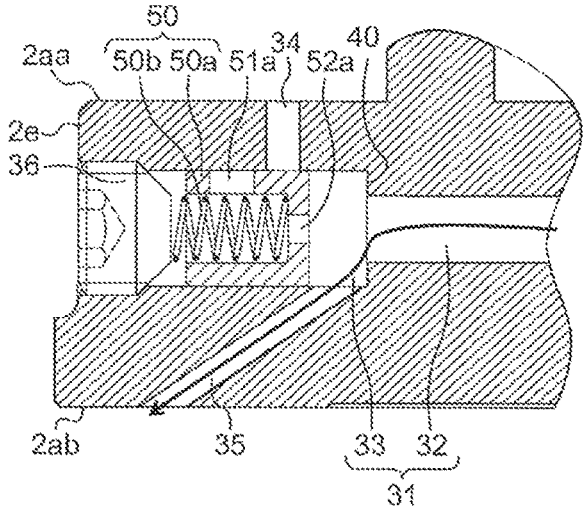
FIG. 13 illustrates a state of the opening and closing mechanism in the high-speed operation of the scroll compressor according to Embodiment 3.

FIG. 12 illustrates a state of the opening and closing mechanism in the low-speed operation of the scroll compressor according to Embodiment 3. FIG. 13 illustrates a state of the opening and closing mechanism in the high-speed operation of the scroll compressor according to Embodiment 3.

The valve body 50*a* operates depending on the pressure in the first flow passage 32 in the same manner as in Embodiment 1. In the low-speed operation, as illustrated in FIG. 12, the valve body 50*a* is in contact with the step 40. In this state, the first flow passage 32 communicates with the lap-side oil supply hole 34 via the through-hole 52*a* and the communication hole 51*a*. Furthermore, the thrust-surface-side oil supply hole 35 is closed by an outer circumferential surface of the cylindrical portion 51 of the valve body 50*a*, Therefore, the oil supplied to the first flow passage 32 is supplied only to the lap-side oil supply hole 34 through the through-hole 52*a*, the second flow passage 33, and the communication hole 51*a*. No oil is supplied to the thrust-surface-side oil supply hole 35.

In the high-speed operation, as illustrated in FIG. 13, the valve body 50*a* moves away from the step 40 and outward in the radial direction. Thus, the thrust-surface-side oil supply hole 35 is opened, and the oil supplied to the first flow passage 32 is supplied to the thrust-surface-side oil supply hole 35 through the second flow passage 33.

As described above, in Embodiment 3, it is possible to obtain the same advantages as in Embodiment 1. In the above example, when the valve body 50*a* moves outward in the radial direction, the lap-side oil supply hole 34 is closed by the outer circumferential surface of the cylindrical portion 51 of the valve body 50*a*. However, the lap-side oil supply hole 34 may be closed in the above manner or may not be closed. In the case where the lap-side oil supply hole 34 is closed by the valve body 50*a*, the whole of the oil in the first flow passage 32 is supplied to the thrust surface 2*ab* through the thrust-surface-side oil supply hole 35, thus further improving the reliability of the sliding parts in the high-speed operation. It should be noted that when the lap-side oil supply hole 34 is closed, oil is not supplied to compression chambers 9 through the lap-side oil supply hole 34, however, since in the high-speed operation, a large amount of oil circulates, such a refrigerant leak as described above does not occur in the compression mechanism 3.

Embodiment 4

In Embodiment 4, the urging part 50*b* is a tension spring. In this regard, Embodiment 4 is different form Embodiment 1. The following description is made by referring mainly to the differences between Embodiments 1 and 4. Regarding Embodiment 4, configurations that are the same as those in Embodiment 1 will not be described.

Figure 14:
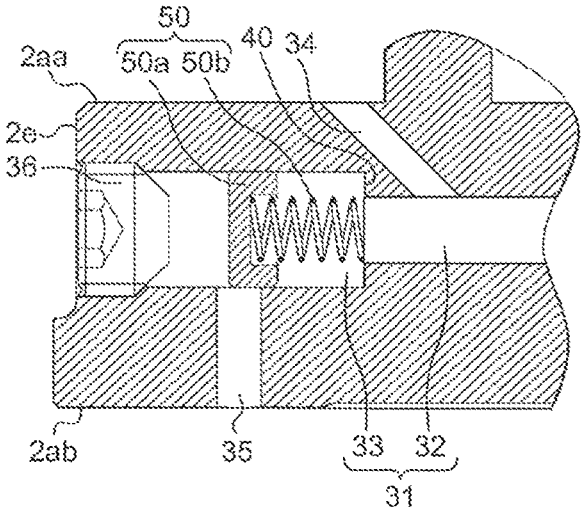
FIG. 14 is a schematic sectional view of related part of a scroll compressor according to Embodiment 4.

FIG. 14 is a schematic sectional view of related part of a scroll compressor according to Embodiment 4.

In Embodiment 4, an urging part 50*b* is a tension spring that urges a valve body 50*a* inward in the radial direction and is pulled when the valve body 50*a* moves outward in the radial direction. The urging part 50*b* is fixed to the valve body 50*a*. An operation principle in Embodiment 4 in which the urging part 50*b* is a tension spring and the way of setting of oil supply holes in Embodiment 4 are similar to those in the embodiment described above.

In the examples described above regarding Embodiments 1 to 4, the scroll compressors are of the low-pressure shell type. However, the present disclosure is also applicable to a high-pressure shell compressor in which the container 100 is filled with refrigerant compressed by the compression mechanism 3.

In the examples described above regarding Embodiments 1 to 4, the slider 4 provided with the balancer is provided inward of the orbiting bearing 5 such that the slider is rotatable. However, the present disclosure is also applicable to a compressor in which a slider is not provided with a balancer.

In the examples described above regarding Embodiments 1 to 4, the single oil passage 31 is provided. However, a plurality of oil passages 31 may be provided. In the case where a plurality of oil passages 31 are provided, it suffices that for each of the oil passages 31, the opening and closing mechanism 50, the lap-side oil supply hole 34, and the thrust-surface-side oil supply hole 35 are provided.

Although Embodiments 1 to 4 are described above as different embodiments, structural features of the embodiments may be appropriately combined into a scroll compressor. For example, Embodiments 2 and 3 may be combined into a scroll compressor having the plurality of thrust-surface-side oil supply holes 35 as illustrated in FIG. 10 and the valve body 50*a* as illustrated in FIG. 11. Furthermore, Embodiments 3 and 4 may be combined into a scroll compressor including the opening and closing mechanism 50 in which the valve body 50*a* is configured as illustrated in FIG. 12 and the urging part 50*b* is a tension spring.

Embodiment 5

Embodiment 5 relates to a refrigeration cycle apparatus including the scroll compressor configured as described above.

Figure 15:
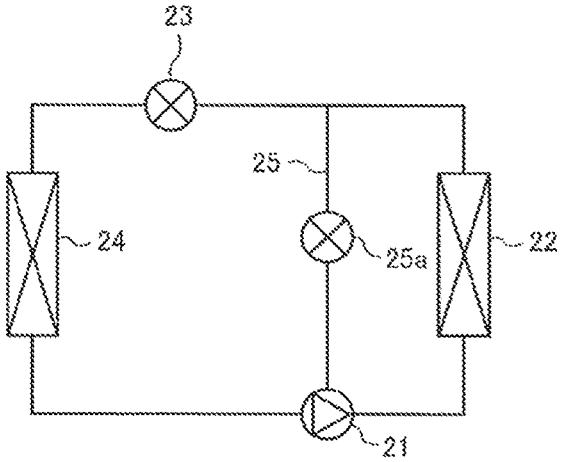
FIG. 15 illustrates a refrigerant circuit of a refrigeration cycle apparatus according to Embodiment 5.

FIG. 15 illustrates a refrigerant circuit of the refrigeration cycle apparatus according to Embodiment 5.

The refrigeration cycle apparatus includes the scroll compressor 21, a condenser 22, an expansion valve 23 serving as a pressure reducing device, and an evaporator 24. The refrigeration cycle apparatus further includes an injection circuit 25 that branches off from a location between the condenser 22 and the expansion valve 23, and is connected to the scroll compressor 21. The injection circuit 25 includes an expansion valve 25*a* serving as a flow control valve. As the scroll compressor 21, any of the scroll compressors according to Embodiments 1 to 4 as described above is used.

In the refrigeration cycle apparatus having the above configuration, gas refrigerant discharged from the scroll compressor 21 flows into the condenser 22, and exchanges heat with air that passes through the condenser 22 to change into high-pressure liquid refrigerant. The high-pressure liquid refrigerant then flows out of the condenser 22. The high-pressure liquid refrigerant that has been flowed out of the condenser 22 is reduced in pressure by the expansion valve 23 to change into low-pressure two-phase gas-liquid refrigerant. Then, the low-pressure two-phase gas-liquid refrigerant flows into the evaporator 24. The low-pressure two-phase gas-liquid refrigerant that has flowed into the evaporator 24 exchanges heat with air that passes through the evaporator 24 to change into low-pressure gas refrigerant. The low-pressure gas refrigerant is re-sucked into the scroll compressor 21.

Injection refrigerant, which is part of the refrigerant discharged from the scroll compressor 21 and having passed through the condenser 22, flows into the injection circuit 25, passes through the expansion valve 25*a*, and flows into the injection pipe 103 of the scrod compressor 21. The injection refrigerant, which is liquid or two-phase refrigerant that has flowed into the injection pipe 103, is injected into the lap-side suction space 74 or the compression chambers 9.

The refrigeration cycle apparatus having the above configuration includes the above scroll compressor, and can thus be improved in both the performance in the low-speed operation and the reliability of the sliding parts in the high-speed operation.

The refrigeration cycle apparatus can be applied to, for example, a refrigerator, a freezer, a vending machine, an air-conditioning apparatus, a refrigeration apparatus, or a water heating apparatus.

The invention claimed is:

1. A scroll compressor comprising:

a container including an oil sump configured to collect oil;

a compression mechanism housed in the container, and configured to compress refrigerant that flows into the container;

a rotating shaft configured to drive the compression mechanism, and having an oil supply passage; and an oil pump configured to be driven by rotation of the rotating shaft to supply the oil collected in the oil sump to the oil supply passage in the rotating shaft, wherein the compression mechanism includes a fixed scroll and an orbiting scroll including an orbiting bedplate and an orbiting lap formed at the orbiting bedplate, in the orbiting bedplate, an oil passage, a lap-side oil supply hole, and a thrust-surface-side oil supply hole are formed, the oil passage is configured as a passage through which the oil supplied from the oil supply passage flows from inner part of the oil passage in a radial direction of the orbiting bedplate toward outer part of the oil passage in the radial direction, the lap-side oil supply hole causes the oil passage to communicate with a lap-formation surface of the orbiting bedplate at which the orbiting lap is formed, the thrust-surface-side oil supply hole causes the oil passage to communicate with a thrust surface of the orbiting bedplate that is opposite to the lap-formation surface of the orbiting bedplate, in the oil passage, an opening and closing valve is provided, the opening and closing valve being configured to close the thrust-surface-side oil supply hole when a pressure of the oil in the oil passage is low, and open the thrust-surface-side oil supply hole when the pressure of the oil in the oil passage is high, the oil passage includes a first passage portion that is located in the inner part of the oil passage in the radial direction, and a second passage portion that is located in the outer part of the oil passage in the radial direction and outward of the first passage portion in the radial direction, the second passage portion having a larger diameter than the first passage portion, the lap-side oil supply hole extends from the first passage portion to the lap-formation surface, the thrust-surface-side oil supply hole extends from the second passage portion to the thrust surface, the opening and closing valve is disposed in the second passage portion, the opening and closing valve includes a valve body configured to slide in the oil passage to open or close the thrust-surface-side oil supply hole and an urging part configured to urge the valve body in a direction in which the thrust-surface-side oil supply hole is closed, and when a pressure of the oil that acts on the valve body in the oil passage exceeds a value of an urging force of the urging part, the valve body moves outward in the radial direction in the oil passage to open the thrust-surface-side oil supply hole.

2. The scroll compressor of claim 1, wherein the valve body is pressed by the urging force of the urging part against a step formed by the first passage portion and the second passage portion to close the thrust-surface-side oil supply hole.

3. The scroll compressor of claim 1, wherein a plurality of thrust-surface-side oil supply holes including the thrust-surface-side oil supply hole are provided in the orbiting bedplate and spaced from each other in the radial direction.

4. The scroll compressor of claim 1, wherein the urging part is a compression spring that is compressed when the valve body moves outward in the radial direction.

5. The scroll compressor of claim 1, wherein the urging part is a tension spring that is pulled when the valve body moves outward in the radial direction.

6. The scroll compressor of claim 1, wherein the thrust-surface-side oil supply hole has a larger diameter than the lap-side oil supply hole.

7. The scroll compressor of claim 1, wherein the scroll compressor is a low-pressure shell type scroll compressor in which the container is filled with the refrigerant that has not yet been compressed by the compression mechanism.

8. The scroll compressor of claim 1, wherein the oil pump is a positive displacement pump.

9. The scroll compressor of claim 8, wherein the oil pump is a trochoid pump.

10. The scroll compressor of claim 1, further comprising:

an injection pipe configured to inject the refrigerant into a lap-side suction space located around the orbiting lap or a compression chamber in the compression mechanism in which compression is being performed.

11. The scroll compressor of claim 1, wherein the refrigerant is carbon dioxide.

12. A refrigeration cycle apparatus comprising the scroll compressor of claim 1.

13. The scroll compressor of claim 1, wherein a diameter of the valve body is larger than a diameter of the first passage portion.

14. A scroll compressor comprising:

a container including an oil sump configured to collect oil;

a compression mechanism housed in the container, and configured to compress refrigerant that flows into the container;

a rotating shaft configured to drive the compression mechanism, and having an oil supply passage; and an oil pump configured to be driven by rotation of the rotating shaft to supply the oil collected in the oil sump to the oil supply passage in the rotating shaft, wherein the compression mechanism includes a fixed scroll and an orbiting scroll including an orbiting bedplate and an orbiting lap formed at the orbiting bedplate, in the orbiting bedplate, an oil passage, a lap-side oil supply hole, and a thrust-surface-side oil supply hole are formed, the oil passage is configured as a passage through which the oil supplied from the oil supply passage flows from inner part of the oil passage in a radial direction of the orbiting bedplate toward outer part of the oil passage in the radial direction, the lap-side oil supply hole causes the oil passage to communicate with a lap-formation surface of the orbiting bedplate at which the orbiting lap is formed, the thrust-surface-side oil supply hole causes the oil passage to communicate with a thrust surface of the orbiting bedplate that is opposite to the lap-formation surface of the orbiting bedplate, in the oil passage, an opening and closing valve is provided, the opening and closing valve being configured to close the thrust-surface-side oil supply hole when a pressure of the oil in the oil passage is low, and open the thrust-surface-side oil supply hole when the pressure of the oil in the oil passage is high, the opening and closing valve includes a valve body configured to slide in the oil passage to open or close the thrust-surface-side oil supply hole and an urging part configured to urge the valve body in a direction in which the thrust-surface-side oil supply hole is closed, when a pressure of the oil that acts on the valve body in the oil passage exceeds a value of an urging force of the urging part, the valve body moves outward in the radial direction in the oil passage to open the thrust-surface-side oil supply hole, the oil passage includes a first passage portion that is located in the inner part of the oil passage in the radial direction, and a second passage portion that is located in the outer part of the oil passage in the radial direction and outward of the first passage portion in the radial direction, the second passage portion having a larger diameter than the first passage portion, the lap-side oil supply hole extends from the second passage portion to the lap-formation surface, the thrust-surface-side oil supply hole extends from the second passage portion to the thrust surface, the valve body includes a cylindrical portion configured to slide in the second passage portion and a circular plate portion that closes an opening of the cylindrical portion that is located on a first passage portion side, the circular plate portion having a through-hole in central part of the circular plate portion, the cylindrical portion has a communication hole that communicates with the lap-side oil supply hole while the valve body is being pressed by the urging force of the urging part against a step formed by the first passage portion and the second passage portion, and while the valve body is being pressed against the step, the first passage portion communicates with the lap-side oil supply hole via the through-hole, the second passage portion, and the communication hole, and the valve body closes the thrust-surface-side oil supply hole.

* * * * *